US006913388B2

(12) United States Patent
Laske

(10) Patent No.: US 6,913,388 B2
(45) Date of Patent: Jul. 5, 2005

(54) FLEXIBLE CONTAINER

(75) Inventor: Louis L. Laske, Libertyville, IL (US)

(73) Assignee: Vonco Products, Inc., Lake Villa, IL (US)

( * ) Notice: Subject to any disclaimer, the term of this patent is extended or adjusted under 35 U.S.C. 154(b) by 0 days.

(21) Appl. No.: 10/165,633

(22) Filed: Jun. 7, 2002

(65) Prior Publication Data

US 2003/0228077 A1 Dec. 11, 2003

(51) Int. Cl.[7] ..... B65D 33/16

(52) U.S. Cl. ..... 383/66; 383/5; 383/88; 383/107; 383/109; 383/903

(58) Field of Search ..... 383/66, 88, 89, 383/107, 108, 903, 5, 109

(56) References Cited

U.S. PATENT DOCUMENTS

| | | | | | |
|---|---|---|---|---|---|
| 3,388,789 | A | * | 6/1968 | Simandl et al. | 383/203 |
| 4,509,196 | A | * | 4/1985 | Sak et al. | 383/5 |
| 4,510,621 | A | | 4/1985 | Sak et al. | |
| 4,709,399 | A | * | 11/1987 | Sanders | 383/66 |
| 4,759,643 | A | * | 7/1988 | Canno | 383/84 |
| 4,961,503 | A | * | 10/1990 | Bell | 383/5 |
| 5,046,621 | A | * | 9/1991 | Bell | 383/5 |
| 5,048,692 | A | * | 9/1991 | Handler et al. | 383/203 |
| 5,056,930 | A | | 10/1991 | Mestetsky | |
| 5,102,234 | A | | 4/1992 | Levy | |
| 5,174,659 | A | | 12/1992 | Laske | |
| 5,287,960 | A | * | 2/1994 | Kalb et al. | 206/210 |
| 5,336,123 | A | | 8/1994 | Laske et al. | |
| 5,364,385 | A | | 11/1994 | Harms et al. | |
| 5,647,480 | A | | 7/1997 | Insley et al. | |
| 6,083,584 | A | | 7/2000 | Smith et al. | |
| 6,117,505 | A | | 9/2000 | Weiss et al. | |

FOREIGN PATENT DOCUMENTS

| | | | | |
|---|---|---|---|---|
| GB | 2177677 A | * | 1/1987 | 383/66 |
| WO | WO9115406 | * | 10/1991 | 383/66 |

* cited by examiner

*Primary Examiner*—Jes F. Pascua
(74) *Attorney, Agent, or Firm*—Pauley Petersen & Erickson

(57) ABSTRACT

A flexible container formed by sealing at least two webs of material with respect to each other to form a void between the webs. Each web preferably has at least two layers. A first web has a first thickness, and a closure area. In at least a portion of the closure area, the first web has a second thickness which is less than the first thickness. A void opening formed in the first web at the closure area provides access to the void. A layer of adhesive is applied to the first web at the closure area to provide for a leak-proof seal at the closure area when the flexible container is folded with respect to the void opening.

22 Claims, 6 Drawing Sheets

FLEXIBLE CONTAINER

BACKGROUND OF THE INVENTION

1. Field of the Invention

This invention relates to a flexible container, particularly a flexible container that can withstand high sustained internal pressures and extreme temperature conditions, making it suitable for containing and transporting toxic and other hazardous materials both by ground and by high-altitude aircraft.

2. Description of Related Art

Under new Federal Aviation Administration (FAA), in the United States, testing criteria in the United States, a container must be able to withstand a sustained internal pressure of about 14 psi for at least about 30 minutes in order to be suitable for transporting toxic and other hazardous materials, using air transportation. For example, if an airplane traveling at an elevation of about 42,000 feet is depressurized, the container must withstand a net effect of an internal pressure of about 14 psi in order to remain sealed. Many conventional containers, particularly flexible containers, cannot withstand such high internal pressure. As a result, a conventional flexible container leaks through a closure which sealably closes a container opening, breaks at a weak peripheral seal or deforms or expands at a region and develops an opening, whereby the materials contained within the container leak from the container.

For example, it is very difficult to provide a flexible container that can withstand high internal pressures and maintain a leak-proof closure. To withstand high internal pressures, conventional flexible containers are constructed of relatively thick materials that require a longer sealing dwell time to effect a peripheral seal that allows the internal pressure to approach a limit or maximum strength of the container material. With heavier materials it becomes increasingly difficult to provide a leak-proof container closure.

Thus, leaks develop at a weak portion of the closure or seal joining the materials, particularly when the flexible container is subjected to a high internal pressure. Further, when the thick materials are folded to form a seal about an opening in the container, the walls of the container near the opening do not sufficiently contact each other to form a leak-proof seal. The materials forming the walls of the container have a shape memory or bias force which urges the materials from a sealed position to an initial flat position.

Conventional flexible containers may not be able to withstand extreme temperatures, particularly as they occur at or near endpoints of a range from about −40° F. to about 130° F. , and particularly over a prolonged time period, for example at least about 2 hours.

There is an apparent need for a flexible container which is suitable for shipping or transporting hazardous materials by air.

There is also an apparent need for a flexible container which can withstand a high sustained internal pressure, for example when subjected to decompression pressure effects at high altitudes, and/or where the materials and closure structure can withstand a temperature operating range of about −40° F. to about 130° F. , particularly over a prolonged time period.

SUMMARY OF THE INVENTION

It is an object of this invention to provide a flexible container that can withstand a high sustained internal pressure and that provides a leak-proof closure during extreme temperatures, particularly over a prolonged time period.

It is another object of this invention to provide a flexible container that can withstand a sustained internal pressure of about 14 psi for at least about 30 minutes in order to be suitable for transporting toxic or other hazardous materials using air transportation, such as an airplane.

It is yet another object of this invention to provide a flexible container able to withstand extreme temperatures ranging from about −40° F. to about 130° F. , over a prolonged period of time.

The new FAA testing criteria require that a container for transporting hazardous materials must be able to withstand a sustained internal pressure of about 14 psi and a temperature operating range of −40° F. to 130° F. for a prolonged period of time.

The above and other objects of this invention are accomplished with a flexible container having at least two webs sealed with respect to each other about a periphery of the flexible container, to form a void between the webs. Preferably, each web has at least two layers, wherein a first layer is coextensive with a second layer. The first layer and the second layer of each web may comprise any suitable material. For example, at least one web may include a first layer of a polyester or nylon material and a second layer of a polyethylene material or other suitable polymer material. Suitable materials for forming the web layers are known to those skilled in the art of flexible bag construction and manufacturing.

In one preferred embodiment of this invention, a first web has a first thickness and a closure area. Within at least a portion of the closure area, the first web has a second thickness which is less than the first thickness. An opening is formed in the closure area to provide access to the void, and a layer of adhesive is applied to the first web at the closure area. If one side or one half of the flexible container has two or more webs, the opening can be within the innermost web, the outermost web and/or any intermediate web. In one preferred embodiment of this invention, the opening comprises a slit positioned along a fold line passing through the closure area. A cover strip is preferably applied to the adhesive layer, wherein the adhesive layer is sandwiched between the closure area of the first web and the cover strip.

In one preferred embodiment of this invention, the first web forms a cutout area within the closure area. A fold layer is sealed to the first web at the first layer and/or the second layer, about at least a portion of the cutout area. Preferably, the fold layer is heat sealed or otherwise adhered to the first web. Alternatively, the fold layer can be integrated with the first web. A layer of adhesive is applied to an outer surface of at least one layer of at least one web, on the side of the flexible container having the opening. A cover strip is positioned on the adhesive layer, wherein the adhesive layer is sandwiched between the closure area of the first web and the cover strip.

In one preferred embodiment of this invention, within the closure area at least one of the webs has an area of weakening near the opening. The area of weakening may include: a structural relief formed in at least one web at or near the opening; a cutout area at the closure area of the first web, and a fold layer sealed to the first web about the cutout area; and/or a first web having a second thickness in the closure area which is less than the first thickness.

For example, preferably at least one of the webs of the flexible container has a structural relief near one or both opposing end portions of the opening or slit. The structural relief may comprise: a reduced thickness at the fold line, at least partially across a width of the flexible container, in at least one layer of at least one web; at least one layer of at least one web having a notched area, wherein the notched area extends at least a portion of a distance between an outer edge of the flexible container and at least one corresponding end portion of the opening; a second slit within each web; and/or a score line within each web. If the structural relief includes a notched area, it is not necessary for the notched area to encompass or extend as far as the outer edge of the flexible container.

Other objects and advantages of this invention will be apparent to those skilled in the art from the following detailed description taken in conjunction with the appended claims and drawings.

BRIEF DESCRIPTION OF THE DRAWINGS

The drawings show different features of a flexible container, according to preferred embodiments of this invention, wherein.

DETAILED DESCRIPTION OF PREFERRED EMBODIMENTS

Figure 7:
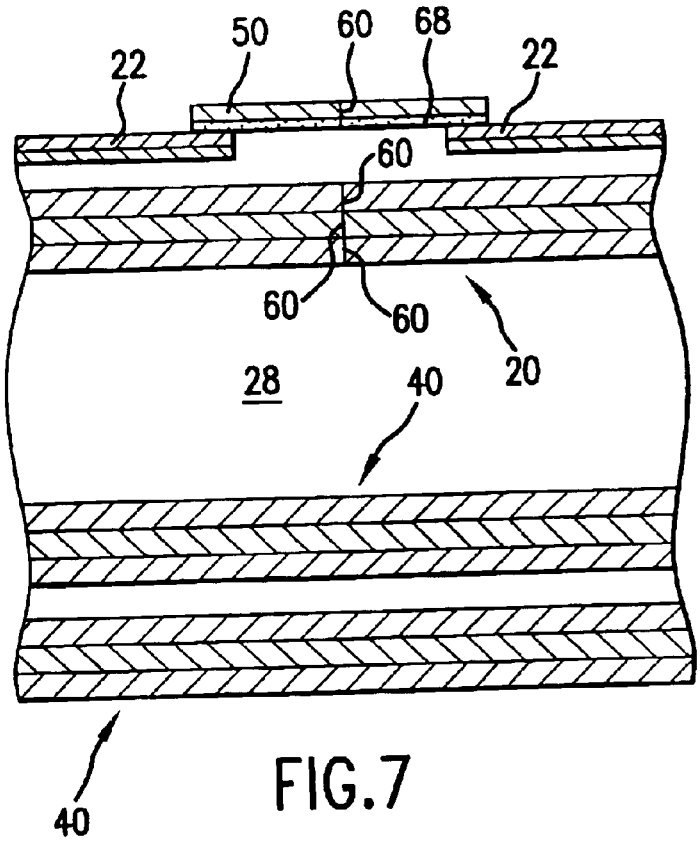
FIG. 7 is a partial cross-sectional side view of a flexible container, wherein each side of the flexible container has two webs, according to another preferred embodiment of this invention.
Figure 8:
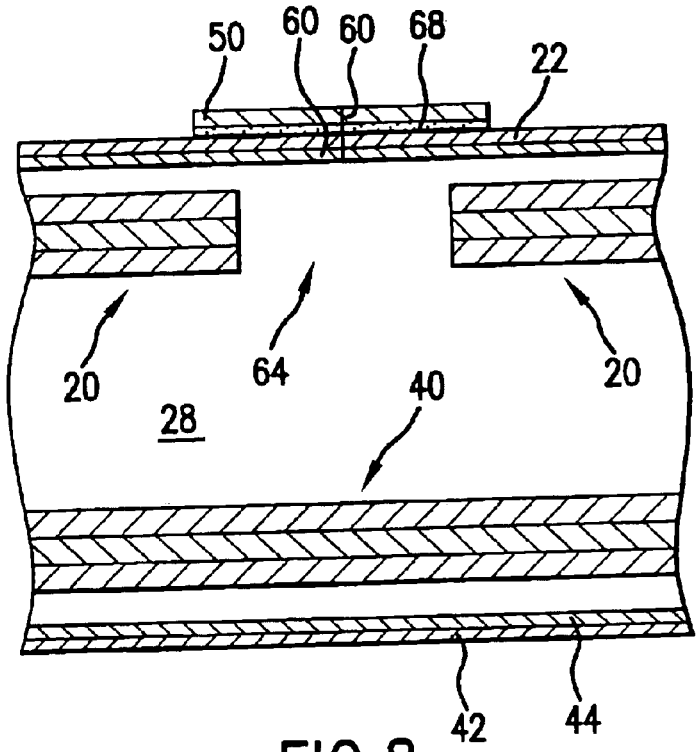
FIG. 8 is a partial cross-sectional side view of a flexible container, wherein each side of the flexible container has two webs, according to another preferred embodiment of this invention.

As shown in FIGS. 1–6, in one preferred embodiment of this invention, a flexible container 10 comprises a first web of material 20 and a second web of material 40, one on each side of flexible container 10, sealed with respect to each other to form a void 28 between webs 20, 40. FIGS. 7 and 8 show other embodiments of flexible container 10 having four total webs: a primary first web 20 and a secondary first web 20 on one side of flexible container 10; and a primary second web 40 and a secondary second web 40 on the other side of flexible container 10. Also, any side of flexible container 10 can have more than two webs 20, 40.

The term "flexible" refers to the ability of flexible container 10 to bend, stretch, expand or contract, for example, without permanent deformation or failure, to adapt to changing environments, for example a change in pressure or change in temperature. It is apparent that flexible container 10 and/or void 28 formed between webs 20, 40 can have any suitable shape and/or dimensions which allows flexible container 10 to function properly for a particular purpose. Flexible container 10 may comprise at least one component or element similar to a corresponding component or element as taught in U.S. Pat. No. 5,336,123 issued to Laske et al. on Aug. 9, 1994, the disclosure of which is incorporated by reference into this specification.

Throughout this specification, as discussed above, one side of flexible container 10 may include one or more first webs 20 and the opposing side of flexible container 10 may comprise one or more second webs 40. As different elements and features are discussed throughout this specification, when referring to one first web 20 and/or one second web 40, such discussion can be interchanged with discussion related to either side of flexible 10 having two or more first webs 20 and/or two or more second webs 40.

Figure 1:
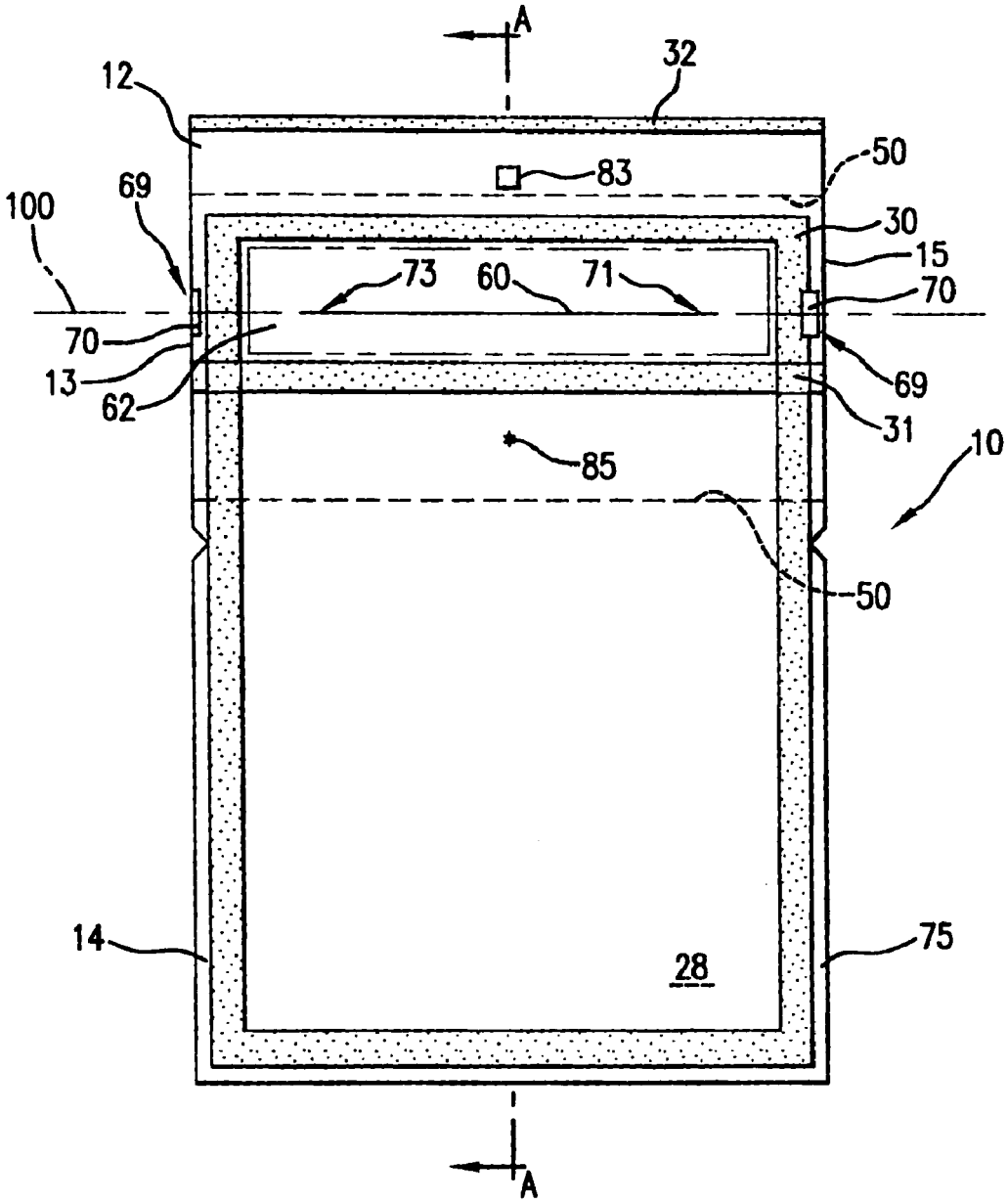
FIG. 1 is a plan front view of a flexible container in a flat or unfolded condition, according to one preferred embodiment of this invention.

Preferably, first web 20 and second web 40 are heat sealed to form a continuous seal 30 about a periphery of flexible container 10, as shown in FIG. 1. Any other suitable process for sealing, as known to those skilled in the art, can be used to form one or more continuous seals between webs 20, 40. In one embodiment, seal 30 preferably has a width of at least about 0. 125 inch, and more preferably at least about 0. 375 inch, or larger or smaller depending upon the overall size of flexible container 10 and the material which flexible container 10 may contain. In another embodiment, seal 30 can have a variable width and/or any other shape at any point or in any direction about the periphery of seal 30. It is apparent that other suitable bonding means, for example adhesives and the like, may be used to form seal 30 and attach or bond webs 20, 40. Flexible container 10 may comprise additional seals, as required. For example, if the side of flexible container 10 that has opening 60 has two or more first webs 20, then a seal 31 such as shown in FIG. 1 can be used to heat seal the two or more first webs 20 together, wherein seal 31 surrounds or is below opening 60, as shown in FIG. 1. In another embodiment, a seal 32 extends along at least a portion at or near a top edge and/or a bottom edge of flexible container 10 to seal first web 20 to second web 40.

Preferably, each web 20, 40 has a total thickness of about 0. 003 inch to about 0. 010 inch and comprises at least two layers of material that are coextensive. The term "coextensive" as used throughout this specification and in the claims refers to the positioning of web 20 with respect to web 40, wherein web 20 is aligned with web 40 such that web 20 and web 40 generally have the same or similar outer boundaries, for example boundaries forming the edges of flexible container 10. In one preferred embodiment of this invention, first web 20 includes a first or outer layer 22 made of a polymer material, such as a polyester or nylon or other similar material, having a thickness of about 0. 00025 inch to about 0. 0015 inch and a second or inner sealant layer 24 made of a polymer material having a thickness of about 0. 0005 inch to about 0. 006 inch. First layer 22 may comprise a 0. 00060 inch, for example, biaxial oriented nylon material, such as available from Clear-Lam, located in Illinois, United States. The biaxial oriented nylon material provides a strong structure due to equal or similar tensile strengths in the longitudinal direction and the lateral direction of the material. Preferably, second layer 24 comprises a 0. 0015 inch polyethylene material available from Southern Films located in Florida, U.S.A. , a material which is known as a linear low density polyethylene. Other suitable materials known to those skilled in the art may be used to make the first layer and/or the second layer of first web 20 and/or second web 40.

Similarly, second web 40 includes a first layer 42 and a second layer 44. Preferably but not necessarily, first layer 42 comprises a material the same or similar to first layer 22 of first web 20 and second layer 44 comprises a material the same or similar to second layer 24 of first web 20. Alternatively, first layer 42 and second layer 44 may comprise a different material than first layer 22 and second layer 24, respectively. In one preferred embodiment of this invention as shown in FIG. 7, second first web 20 and first and second webs 40 each comprises a third layer sealed with respect to layers 22, 24 and/or 42, 44, respectively. For example, a third layer 26 (not shown) made of 0. 0015 inch polyethylene, for example, may be sealed with respect to first layer 22 to sandwich or position first layer 22 between second layer 24 and third layer 26.

First layers 22, 42 and second layers 24, 44, and any additional layers, may be made of any suitable compatible materials, for example polymer materials, which when combined to form one or more of each of webs 20, 40 exhibit a combined strength capable of withstanding a wide pressure and/or temperature range. The multiple layer, multiple web construction of flexible container 10 provides a strong structure because one layer supports the other layer. Preferably, flexible container 10 is capable of withstanding a constant or sustained internal pressure of at least about 14 psi. The closure at closure area 62 and the corresponding material of the closure can withstand temperatures of about −40° F. to about 130° F. , without deformation of and/or leakage through the closure.

Figure 2:
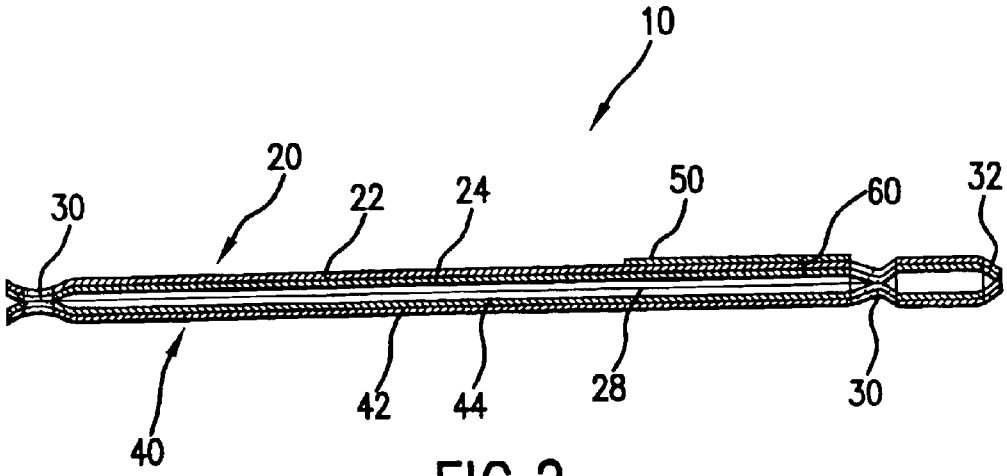
FIG. 2 is a cross-sectional side view of a flexible container along sectional line A—A as shown in FIG. 1, according to one preferred embodiment of this invention.
Figure 3:
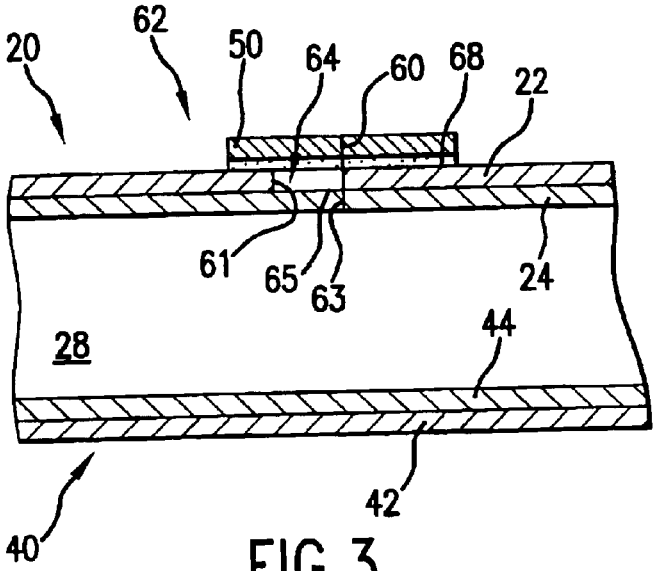
FIG. 3 is a partial cross-sectional side view of a flexible container, according to one preferred embodiment of this invention.

Referring to FIGS. 1–3, first web 20 forms an opening 60 at or within a closure area 62 defined by first web 20 to provide access to void 28. Preferably, but not necessarily, opening 60 comprises a slit which is positioned along, at or near a fold line 100, which passes through closure area 62, as shown in FIG. 1. Opening 60 may extend outward in a direction toward seal 30 any suitable distance. Opening 60 may stop short of seal 30, may extend up to an inner edge of seal 30, may extend into seal 30, may extend up to an outer edge of seal 30, and/or may extend beyond seal 30 into a skirt 75. To whatever point opening 60 extends, there should be a sufficient area of adhesive contact, either adhesive-to-adhesive or adhesive to web 20, to ensure a tight seal at or near end portions 71, 73 of opening 60 to provide a leak-tight seal about opening 60 when flexible container 10 is folded about fold line 100. Further, as a distance between end portion 71 and/or 73 and seal 30 decrease, a width of seal 30 and/or a width of skirt 75 defined by a portion of flexible container 10 between edges 15, 13 of flexible container 10, respectively, and an outer edge of seal 30 preferably but not necessarily increases.

In one preferred embodiment of this invention, first web 20 has a second thickness in closure area 62 which is less than the first thickness of first web 20. For example, preferably only one of first layer 22 and second layer 24 extends to form a portion of opening 60. As shown in FIG. 3, first layer 22 may extend along only a portion of second layer 24 and terminate at an edge 61. Second layer 24 forms at least a portion of opening 60 defined by an edge 63. Preferably, edge 61 terminates at a distance 65 from edge 63, to form a cutout area 64. Distance 65 is about 0. 125 inch to about 1. 0 inch, preferably about 0. 75 inch, or any other suitable length. Additionally, on an opposite side of opening 60, second layer 24 can extend to form a portion of opening 60 along a second edge of second layer 24 opposing edge 63 and first layer 22 can terminate a distance from the second edge of second layer 24, equal to or different than distance 65. In one embodiment of this invention, cutout area 64 is formed about opening 60 in one or more layers of one or more first webs 20. In such embodiment cutout area 64 has a length in a longitudinal direction of flexible container 10 of about 0. 25 inch to about 2. 0 inch, or any other suitable length, and a width which extends at least partially over an entire width of flexible container 10. If opening 60 and notched areas 70 are in the same layer of any first web 20, then opening 60 extends less than a distance between inner edges of two corresponding notched areas 70. If opening 60 and notched area 70 is each within a different layer of 22 or 24 of any first web 20, then at least a portion of opening 60 can overlap with notched area 70.

An adhesive layer 68 is applied to at least a portion of first web 20 at closure area 62 and/or cutout area 64. Any suitable adhesive known to those skilled in the art can be used to form adhesive layer 68. Any adhesive can be used, which provides a sufficiently strong adhesive seal to close opening 60. A cover strip 50 can be applied to or positioned on adhesive layer 68, such that adhesive layer 68 is sandwiched or positioned between first web 20 at closure area 62 and cover strip 50. Preferably, cover strip 50 and adhesive layer 68 form a pressure sensitive tape material, as is well known in the art. The pressure sensitive material can be applied as a preformed material or can be applied in manufacturing steps as the adhesive layer 68 and the cover strip 50.

Figure 4:
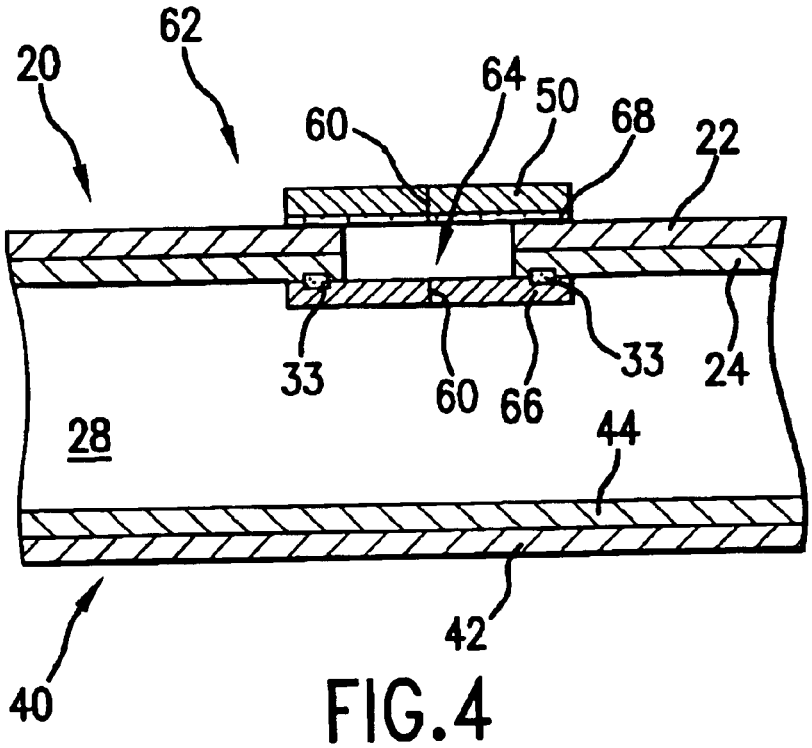
FIG. 4 is a partial cross-sectional side view of a flexible container, according to one preferred embodiment of this invention.
Figure 5:
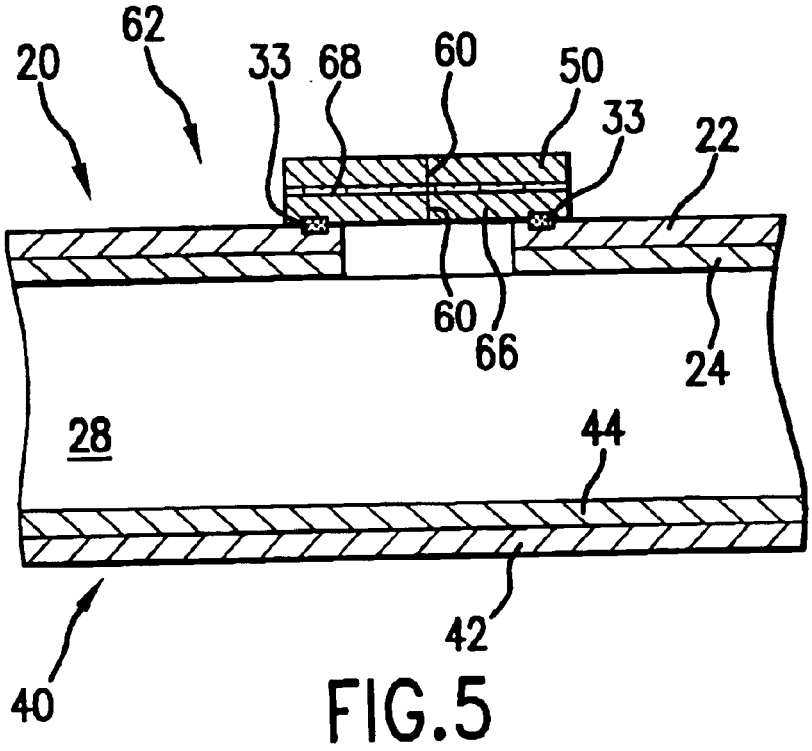
FIG. 5 is a partial cross-sectional side view of a flexible container, according to one preferred embodiment of this invention.

Referring to FIG. 4, in one embodiment of this invention, first web 20 forms cutout area 64 at closure area 62. In one preferred embodiment of this invention, a fold layer 66 overlaps onto a portion of first web 20 and is sealed to any first web 20 on one side of flexible container 10, about cutout area 64. Preferably, but not necessarily, fold layer 66 is heat sealed to first web 20 to form a continuous seal 33. Seal 33 can extend about cutout area 64 and/or can extend into seal 30. As shown in FIG. 4, fold layer 66 is sealed to an inner surface of second layer 24. Alternatively, as shown in FIG. 5, fold layer 66 may be sealed to an outer surface of first layer 22. Preferably, fold layer 66 has a thickness less than a thickness of first web 20, and thus a lesser magnitude of shape memory, to allow a continuous adhesive seal to form about opening 60 when flexible container 10 is folded along fold line 100. As shown in FIG. 1, fold line 100 is collinear with opening 60, but in other embodiments, fold line 100 can be above and/or below opening 60. It is apparent to those skilled in the art that fold layer 66 can be bonded, adhered or otherwise attached to first web 20 using any suitable means which provides a leak-proof seal. Alternatively, fold layer 66 can be integrated with first layer 22 and/or second layer 24 of first web 20. Adhesive layer 68 is applied to at least a portion of an outer surface of fold layer 66 and cover strip 50 is applied to or positioned on adhesive layer 68, such that adhesive layer 68 is sandwiched or positioned between closure area 62 of first web 20 and cover strip 50, as is shown in FIG. 4, or adhesive layer 68 is positioned between fold layer 66 and cover strip 50, as is shown in FIG. 5.

In one preferred embodiment of this invention, at least one web 20, 40 has at least one structural relief 69. As shown in FIG. 1, structural relief 69 is formed by notched areas 70 positioned at or near end portion 71 and/or 73 of opening 60. The term "structural relief" as used throughout this specification and in the claims refers to any structural feature or material property of any one or more layers of web 20, 40 that decreases a magnitude of the shape memory or bias force of web 20, 40. As discussed above, shape memory relates to a folded web 20, 40 that urges itself back to an unfolded position or state, and is one problem associated with conventional flexible containers, and is directly related to container leakage.

In one preferred embodiment of this invention, structural relief 69 comprises a notched area 70 formed in one or more layers of web 20 and/or one or more layers of web 40 and extending a distance on each side of fold line 100, as shown in FIG. 1. Notched area 70 may be formed by removing or otherwise eliminating at least one layer of first web 20 and/or second web 40 at notched area 70. Preferably, first web 20 and/or second web 40 comprises notched area 70 at or near one or both side edges 13, 15 of flexible container 10. As shown on the right side of FIG. 1, notched area 70 need not extend to or have a common boundary with an outer edge 13, 15. Notched area 70 extends at least partially between outer edge 13, 15 of flexible container 10 and respective end portion 73, 71 of opening 60. Depending on the number of layers in each web 20, 40, notched area 70 can extend inward further than end portion 71 and/or 73. Further, notched area 70 may extend through only one layer or more than one layer of first web 20 and/or second web 40, and may extend laterally into a corresponding portion of seal 30.

Figure 6:
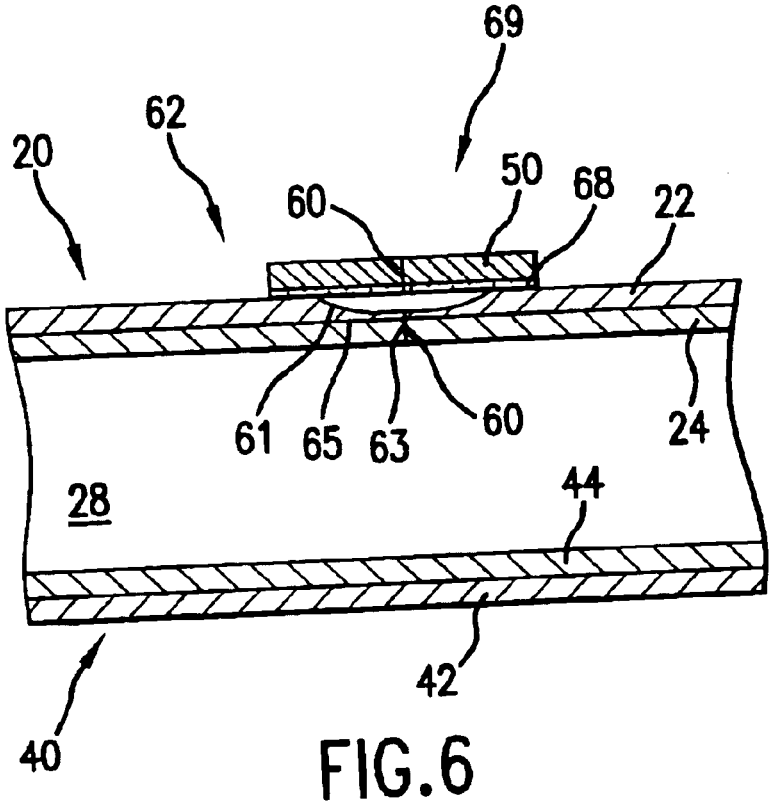
FIG. 6 is a partial cross-sectional side view of a flexible container, according to one preferred embodiment of this invention.

Further, as shown in FIG. 6, structural relief 69 may also comprise at least one of the layers of web 20 and/or at least one of the layers of web 40 having a reduced thickness at fold line 100. In other preferred embodiments of this invention, structural relief 69 may comprise a second slit formed within at least one other web 20, 40 and/or may comprise a score line within at least one web 20, 40. Structural relief 69 may be continuous or intermittent, as required or desired.

Figure 9:
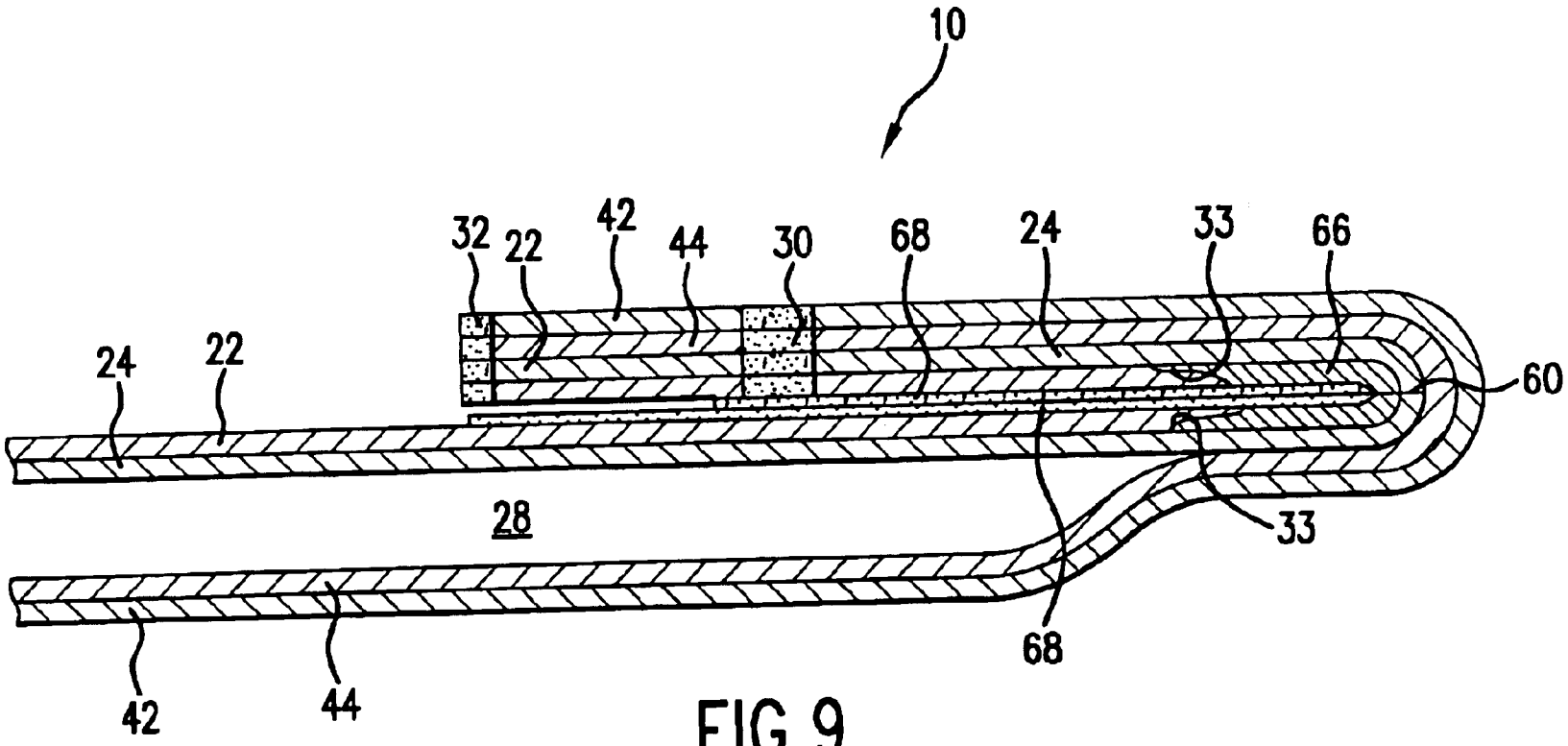
FIG. 9 is a partial cross-sectional side view of a flexible container, wherein each side of the flexible container has one web, showing the flexible container in a folded position.

Referring to FIGS. 1–6, when adhesively sealing opening 60 of flexible container 10 at closure area 62, cover strip 50 is removed, for example by peeling cover strip 50 from adhesive layer 68. As shown in FIG. 9, a top portion 12 of flexible container 10, above fold line 100, is folded to contact a bottom portion 14 of flexible container 10, below fold line 100. Preferably, to provide a tight leak-proof seal, flexible container 10 is folded along fold line 100. Adhesive layer 68 provides a leak-proof seal about opening 60 in closure area 62. In one preferred embodiment of this invention as shown in FIG. 1, at least one structural relief 69, for example notched area 70 is formed in first web 20 and/or second web 40 by preferably, but not necessarily, removing or otherwise eliminating, such as through a manufacturing process, a portion of at least one layer 22, 24 of first web 20 and/or at least one layer 42, 44 of web 40. Preferably, fold line 100 passes through notched area 70. Fold line 100 defines the longitudinal position of opening 60 with respect to flexible container 10.

In one embodiment of this invention, when flexible container 10 is folded about fold line 100, adhesive layer 68 folds over onto itself to form an adhesive-to-adhesive bond and/or folds over onto an outer surface of at least one layer 22, 24 of at least one first web 20 to form an adhesive-to-layer bond. In either case, because of the shape memory or bias force within the at least one layer 22, 24, at fold line 100 the at least one layer 22, 24 has a tenancy to unfold or open flat. By applying more pressure to the at least one layer 22, 24 at fold line 100, the adhesive-to-adhesive and/or the adhesive-to-layer bond strength is increased. Providing one or more notched areas 70 at fold line 100 allows more direct pressure applied at fold line 100 which enhances the bond strength provided by adhesive layer 68.

Further, top portion 12 may include a reference mark 83 and bottom portion 14 may include a reference mark 85 to assist in properly sealing flexible container 10. For example, reference mark 85 may comprise a star which is positionable within reference mark 83, comprising a box, when flexible container 10 is folded to properly register top portion 12 and bottom portion 14 to seal flexible container 10. It is apparent that reference marks 83, 85 can be any desirable mark which allows registration of top portion 12 with bottom portion 14 when flexible container 10 is folded to seal opening 60.

While in the foregoing specification the invention has been described in relation to certain preferred embodiments, and many details are set forth for purpose of illustration, it will be apparent to those skilled in the art that the invention is susceptible to additional embodiments and that certain of the details described in the specification and in the claims can be varied considerably without departing from the basic principles of the invention.

What is claimed is:

1. A flexible container comprising:

two webs sealed with respect to each other to form a void between said webs, each said web having at least two layers, said first web having a closure area, said first web having an opening within said closure area, said opening positioned along a fold line passing through said closure area, with the flexible container in an unfolded condition said opening positioned within a layer of adhesive applied to said first web within said closure area, only one of said first web and said second web having two notched areas, each of said notched areas positioned near one of two opposing outer edges of the flexible container, and said fold line intersecting with said notched areas.

2. The flexible container according to claim 1, further comprising a cover strip applied to said adhesive layer, wherein said adhesive layer is sandwiched between said closure area of said first web and said cover strip.

3. The flexible container according to claim 1, wherein said webs are sealed about a periphery of the flexible container.

4. The flexible container according to claim 1, wherein a first layer of said at least two layers is coextensive with a second layer of said at least two layers.

5. The flexible container according to claim 1, wherein said opening provides access to said void.

6. The flexible container according to claim 1, wherein said at least two layers comprise a first layer of a polyester or nylon material and a second layer of a polyethylene material.

7. The flexible container according to claim 1, wherein a material of said at least one said layer is removed at said notched area.

8. The flexible container according to claim 1, wherein said notched area extends at least partially between said outer edges of the flexible container and at least one of opposing end portions of said opening.

9. The flexible container according to claim 1, wherein said webs are sealed with respect to each other with a heat seal, and said notched area extends into said heat seal.

10. The flexible container according to claim 1, further comprising a secondary first web positioned adjacent said first web on one side of the flexible container.

11. A flexible container comprising:

two webs sealed with respect to each other to form a void between said webs, each said web having at least two layers, said first web having an opening within a closure area, said opening positioned along a fold line passing through said closure area, with the flexible container in an unfolded condition a layer of adhesive applied to said first web within said closure area and surrounding said opening, said second web having two notched areas each near one of two opposing outer edges of the flexible container, said first web at least partially covering each of said notched areas, and said fold line intersecting with said notched areas.

12. The flexible container according to claim 11, wherein said opening comprises a slit.

13. The flexible container according to claim 11, wherein at least one of said layers of at least one of said webs has a reduced thickness at said fold line.

14. The flexible container according to claim 11, wherein a material of at least one said layer is removed at each of said notched areas.

15. The flexible container according to claim 11, wherein each said notched area extends at least partially between one of said outer edges of the flexible container and at least one of opposing end portions of said opening.

16. The flexible container according to claim 11, wherein said webs are sealed with respect to each other with a heat seal, and each said notched area extends into said heat seal.

17. The flexible container according to claim 11, wherein a first web of said webs has a first thickness, and in said closure area said first web having a second thickness which is less than said first thickness.

18. The flexible container according to claim 11, further comprising a cover strip applied to said adhesive layer, wherein said adhesive layer is sandwiched between said closure area of said first web and said cover strip.

19. The flexible container according to claim 11, wherein said webs are sealed about a periphery of the flexible container.

20. The flexible container according to claim 11, wherein a first layer of said at least two layers is coextensive with a second layer of said at least two layers.

21. The flexible container according to claim 11, wherein said opening provides access to said void.

22. The flexible container according to claim 11, further comprising a secondary first web positioned adjacent said first web on one side of the flexible container.

* * * * *